United States Patent [19]

Leidel

[11] Patent Number: 4,519,313

[45] Date of Patent: May 28, 1985

[54] CHARGE HOLDER

[75] Inventor: David J. Leidel, Arlington, Tex.

[73] Assignee: Jet Research Center, Inc., Arlington, Tex.

[21] Appl. No.: 591,710

[22] Filed: Mar. 21, 1984

[51] Int. Cl.[3] ..... F42B 1/02

[52] U.S. Cl. ..... 102/310; 299/13; 102/307; 102/308

[58] Field of Search ..... 102/306, 310; 175/4.6; 299/13

[56] References Cited

U.S. PATENT DOCUMENTS

| | | | |
|---|---|---|---|
| 2,765,739 | 10/1956 | Mohaupt et al. | 102/20 |
| 2,873,676 | 2/1959 | Caldwell | 102/20 |
| 2,883,932 | 4/1959 | Caldwell | 102/20 |
| 2,889,774 | 6/1959 | Allen | 102/310 X |
| 2,947,252 | 8/1960 | Lindsay, Jr. | 102/310 X |
| 3,057,297 | 10/1962 | Brown | 102/21.8 |
| 3,104,611 | 9/1963 | Baks | 102/310 X |
| 3,128,702 | 4/1964 | Christopher | 102/20 |
| 4,071,096 | 1/1978 | Dines | 175/4.6 |
| 4,253,523 | 3/1981 | Ibsen | 102/310 X |
| 4,393,946 | 7/1983 | Pottier et al. | 102/306 X |

FOREIGN PATENT DOCUMENTS

| | | | |
|---|---|---|---|
| 1422004 | 5/1959 | France | 102/310 |

*Primary Examiner*—Peter A. Nelson

*Attorney, Agent, or Firm*—Joseph A. Walkowski; Thomas R. Weaver

[57] ABSTRACT

The present invention comprises a high-density perforating gun in which the shaped charges carried thereby are oriented so that the jets emanating therefrom substantially intersect the axis of the gun. The shaped charges may be vertically spaced by a distance less than the diameter of the charges, but sufficient for each charge jet to pass unobstructed by other jets emanating from the charges immediately above and below.

20 Claims, 5 Drawing Figures

CHARGE HOLDER

BACKGROUND OF THE INVENTION

The present invention relates generally to well perforating, such as is practiced in the petroleum industry, and specifically to carriers for perforating guns holding shaped charges utilized in perforating well bore casing and producing formations.

Shaped charges are employed to perforate casing and surrounding producing formations due to their ability to produce long, tunnel-like perforations in a producing formation without the use of a projectile and without injecting a great deal of debris and residue into the perforations. However, the penetration characteristics of a shaped charge jet are greatly dependent upon the stand-off of the shaped charge, which may be defined as the distance between the base of the liner cone in a shaped charge and the nearest significant obstruction in front of the charge, which may be a cover over the mouth of the charge, the inner wall of a perforating gun carrier, or the inner portion of a plug in a gun port of a carrier, all of which are well known and widely employed in the art. In recent years, the petroleum industry trend has been toward the use of "high density" perforating, which involves the clustering of multiple shaped charges and the stacking of these clusters in the perforating gun carrier to effect 12 or more perforations per foot of interval of producing formation. Charge clusters are usually rotated with respect to the adjacent ones above and below them, to provide rotationally offset perforations which have a reduced tendency to weaken casing and are thought to provide better overall fluid flow from the producing formation. However, clustering of charges bring about a very significant decrease in the stand-off for each shaped charge in the cluster, which in turn decreases penetration of the formation and reduced to a significant degree the advantages of the clustered charges and large number of resulting perforations. In fact, the total available stand-off is generally limited to two (2) inches or less.

The problems associated with reduction of stand-off have been recognized in U.S. Pat. No. 3,429,384, issued to J. B. Shore on Feb. 25, 1969, the disclosure of which deals with the reduction of stand-off associated with the use of a very large shaped charge in a tubular carrier, and indicates that even a fraction of an inch increase in stand-off can result in as much as a twenty percent increase in penetration depth. The patent to Shore discloses the use of a tubular perforating gun carrier having concave depressions machined in the exterior thereof, the centers of which are subsequently dimpled outward with a forming tool placed in the interior of the carrier. The resulting configuration provides an increase in stand-off equal to the depth of the dimple, while the machine depression and resulting thinning of the carrier wall reduces the outward protrusion and thickness of the burr which is formed by the shaped charge adjacent the dimple when it is fired. These latter phenomena make the carrier less likely to stick in the tubing string as it is retrieved. However, the configuration and method of effecting same as disclosed in the patent to Shore possess a number of inherent disadvantages. First, the method of achieving the concavity with dimple therein involves precision machining of the depressions to a predetermined depth and subsequent use of a forming tool, which must be precisely oriented. Second, the reduction of the wall thickness is not practical for carriers having clusters of three, four or even five shaped charges at a single level, due to the unacceptable decrease in compressive strength in the carrier wall, and the possibility of total destruction of the carrier upon firing of the charges, with attendant clogging of the well bore with debris. Furthermore, precise alignment of the shaped charges within the carrier with each dimple is required for maximum effectiveness.

Another perforating gun carrier which addresses the problem of providing adequate stand-off is disclosed in U.S. patent application Ser. No. 491,624, assigned to the assignee of the present invention. The disclosed carrier comprises an inner substantially tubular housing within an outer substantially tubular sleeve. The inner housing includes gun ports extending through the wall thereof in a pattern corresponding to the pattern of shaped charges to be carried within. The sleeve may be secured to the housing in any one of a number of ways, including but not limited to, welding, soldering, brazing or adhesive bonding. Alternatively, the sleeve may be shrink-fit to the housing, or merely slipped over the housing and held in place at either end by mechanical means. While this type of construction increases stand-off by a large degree relative to that formerly obtainable in high density perforating, on an absolute scale the increase is very small, typically being only a fraction of an inch.

SUMMARY OF THE INVENTION

In contrast to the prior art, the high density perforating gun of the present invention represents a quantum leap forward in obtainable stand-off. The present invention comprises a multi-sided shaped charge holder which orients the charge mouths toward the central axis of the tubular carrier within which the gun is housed. The bottoms of the charges are disposed adjacent to the carrier inner wall, and the charge initiation means is likewise disposed adjacent the carrier wall. A vertical row of substantially uniformly spaced shaped charges is mounted in each side of the multi-sided carrier, the charge rows in adjacent sides being staggered so as to permit the unobstructed firing of each charge across the central axis of the gun, into the gun port in the carrier wall and through the casing into the producing formation therebehind. To avoid damage by the debris associated with the initiation of explosive charge jets to closely adjacent charges and the jets emanating therefrom on the interior of the holder, as well as to the charge initiation means on the exterior of the holder, each charge jet travels through a gun barrel, or muzzle tube, disposed at the mouth of the charge and axially aligned therewith. The perforating gun of the present invention is readily seen to increase available stand-off by several inches, as well as to provide the possibility of greater charge density and therefore greater perforation density, through the placement of charges at a vertical distance of less than charge width or diameter. The present invention also permits more uniform perforation spacing, as the perforations are not disposed on discrete planes separated by at least charge width, but are staggered.

BRIEF DESCRIPTION OF THE DRAWINGS

The method and apparatus of the present invention will be more readily understood by one of ordinary skill in the art by reference to the following detailed description, taken in conjunction with the accompanying drawings, wherein.

DETAILED DESCRIPTION OF THE PREFERRED EMBODIMENT

Figure 1:
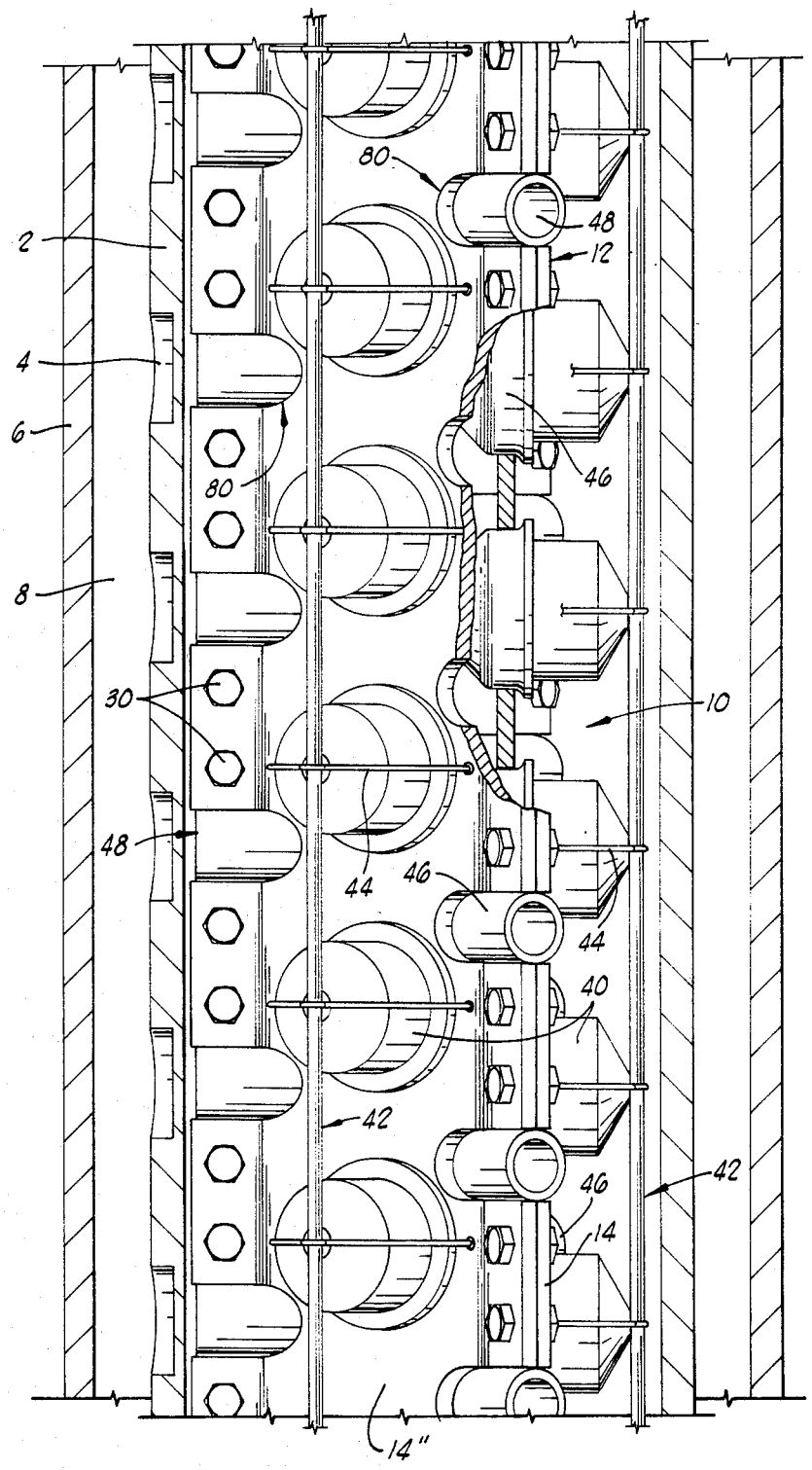
FIG. 1 is a vertical section of a tubular charge carrier containing the preferred embodiment of the perforating gun of the present invention disposed in well bore casing.

Referring to FIG. 1 of the drawings, a portion of the preferred embodiment of the perforating gun 10 of the present invention is shown in place in tubular charge carrier 2 having gun ports 4 of decreased wall thickness formed therein. Carrier 2 is suspended in well bore casing 6, with annulus 8 therebetween. A potential oil, gas or water producing formation (not shown) would typically surround casing 6, although casing may also be perforated for water, steam, or $CO_2$ injection operations, for solution mining, or for hazardous waste disposal. In any event, the utility of the present invention is not to be construed as so limited to any of the foregoing types of wells.

Shaped charges 40 are disposed in vertical rows in each side of holder 12, with clear initiating means known in the art such as detonating cord 42 being secured thereto by spring retainer clips 44. As can most easily be seen in the cutaway area of FIG. 1, muzzle tubes 46 are secured over the mouths of each shaped charge 40, which muzzle tube 46 extend through the muzzle tube ports 80 formed by the adjacent cavities in the joined edges of the charge holder sides. The mouth 48 of each muzzle tube is placed adjacent a gun port 4.

Figure 2:
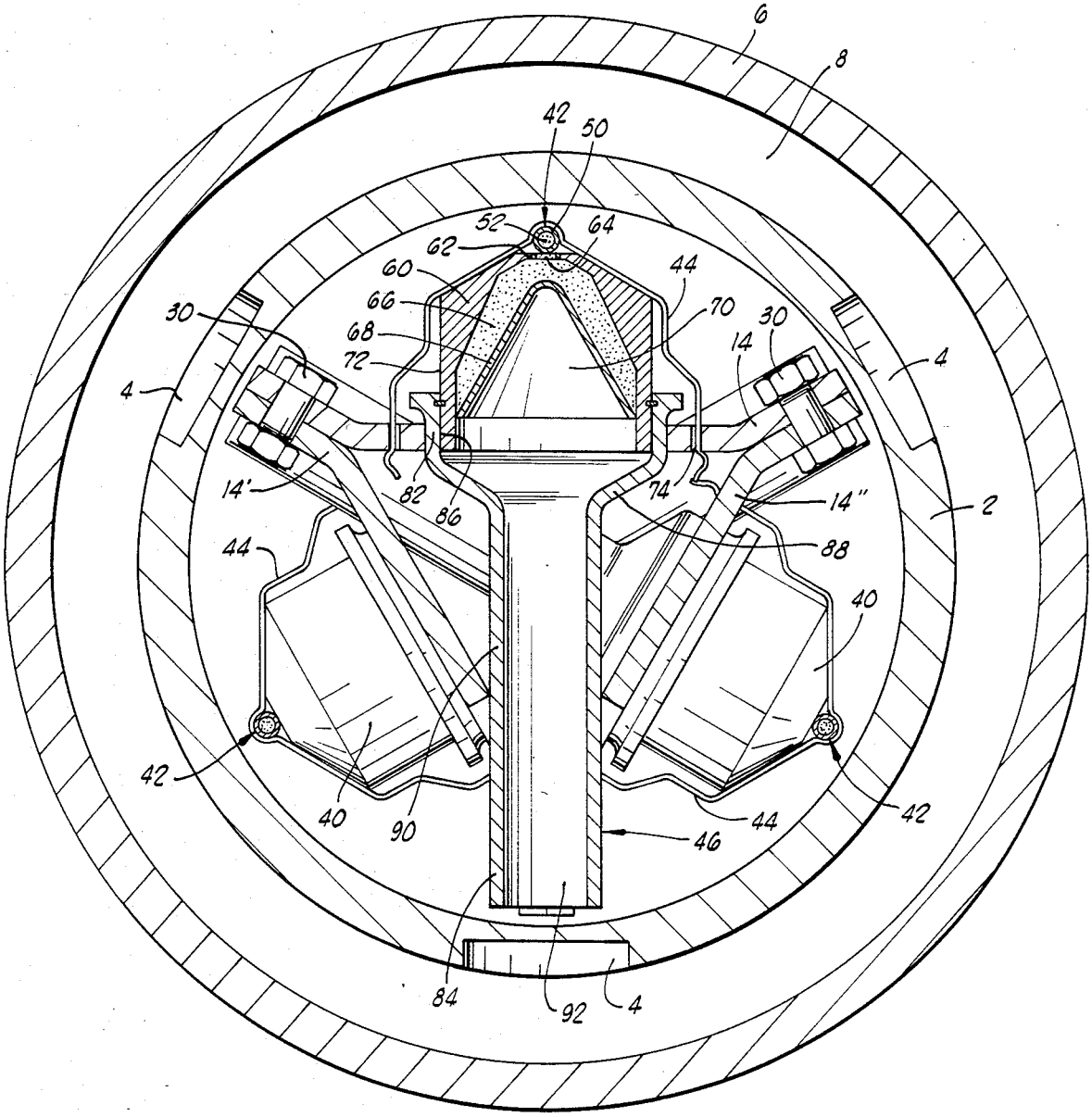
FIG. 2 is a horizontal section across the preferred embodiment of the perforating gun of the present invention as disposed in a tubular charge carrier in a well bore.

FIG. 2 is a horizontal section through charge holder 12 with charges 40, cords 42, retainer clips 44 and muzzle tubes 46 in place. Each detonating cord 42 may include a sheath 50, enclosing an explosive core 52. Sheath 50 may be of any suitable material, nylon, thermoplastic rubber (TPR), lead, aluminum, plastic, silicone, fiberglass, Kevlar ®, polypropylene, or steel, and may be extruded, wrapped, braided or woven. Explosive core 52 may be any suitable explosive, but is preferably 70 grain/foot RDX. Each shaped charge 40 may include a housing 60 having an aperture 62 in the bottom thereof in which is disposed booster charge 64 which initiates shaped explosive 66, which may also be of RDX or any other explosive generally used in such charges, including but not limited to cyclotrimethylenetrinitramine, hexahydro-1,3,5-trinitro-5-triazine, cyclonite, hexogen, T4, commonly referred to as RDX; octogen, known as HMX; or 2,2',4,4',6,6'hexanitrostilbene, known as HNS. If the perforating string is to be employed in a high temperature (above 500° F.) well bore, the explosive compound 2,6-bis(Picrylamino)-3,5,dinitropyridine, known as PYX, may be employed. In addition, wax, polymeric or stearate binders may be employed with the aforesaid explosives. For example, RDX with a calcium stearate binder, commonly known as CH6. Within charge 40 is a charge liner 68, explosive 66 being pressed between liner 68 and housing 60. Mouth 70 of charge 40 is open. The exterior 72 of each charge 40 is cylindrical, and possesses a circumferential groove therein in which snap ring 74 rests.

Muzzle tube 46 has an inlet end 82 adapted to receive the explosive jet from charge 40, and an outlet end 84 adapted to expel the charge jet against gun port 4. Muzzle tube 46 may be formed of metal or any other suitable material, such as fiberglass or ballistic plastic (woven Kevlar ® fibers cast into a matrix). The interior wall 86 of inlet end 82 is of slightly larger diameter than the exterior 72 of charge 40, and extends thereover. Charge 40 is maintained in muzzle tube 46 by spring retainer clip 44, the ends of which are inserted in apertures 74 in charge holder 12. Proximate the mouth 70 of charge 40, muzzle tube 46 necks down at 88 to a smaller diameter wall 90, which defines jet bore 92, extending substantially uniformly to outlet end 84. While only a single charge and muzzle tube combination has been described, it will be understood that all charges 40 and muzzle tubes 46 in a gun may be substantially identical.

Referring now to FIGS. 1, 2, and 3A–3C, gun 10 of the preferred embodiment comprises a three-sided charge holder 12 of equilateral triangular cross-section. Sides 14, 14' and 14'' of charge holder 12 are preferably formed of stamped sheet metal strips. As can readily be seen in FIGS. 3A, 3B and 3C, the center side 14 of charge holder 12 possesses a row of substantially uniformly spaced round charge apertures 16, as well as vertical rows of substantially uniformly spaced cavities 18 along each edge. Cavities 18 have substantially parallel sides 20 which extend into a bottom 22 of substantially elliptical configuration. Between each two cavities 18 are two bolt holes 24, all bolt holes on each edge of side 14 being substantially vertically aligned. Broken lines 26 are bend lines along which the outer edges of side 14 are both bent at substantially a 30° angle to the plane of side 14 on the same side of the plane, as can more readily be seen in FIG. 2.

It is readily apparent that sides 14' and 14'' are substantially identical to side 14 in the relative size and spacing of their charge apertures, cavities, bolt holes and bend lines, and hence these features will not be discussed in detail. However, it is important to note the relative staggering of the charge apertures 16 with respect to those designated 16' and 16'', wherein it may be observed that each charge aperture is vertically offset from the one next laterally adjacent by a distance equal to the distance between the bolt hole centers of each pair of bolt holes. For example, looking at the lowermost charge apertures 16, 16' and 16'' in sides 14, 14' and 14'', it is evident that vertical distance X between the centers of apertures 16 and 16' is equal to the vertical distance Y between the centers of apertures 16 and 16'', and that distances X and Y are each equal to vertical distance Z between the centers of paired bolt holes 24 (as well as 24' and 24''). Stated another way, the charge apertures are vertically offset so as to provide a steplike spiral arrangement of charge placement around holder 12.

Edge cavities 18, 18' and 18'', unlike charge apertures 16, 16' and 16'', are staggered or offset in the side edges so that such cavities are aligned in the same planes as the cavities in the closest edge of the adjacent side. In this manner, when strips 14, 14' and 14'' are assembled together to form charge holder 12, each pair of cavities in joined adjacent charge holder side edges forms a muzzle tube port 80 which is aligned with the charge aperture (16, 16' or 16'') in the third charge holder side opposite the joined edges. This can easily be seen in FIGS. 3A, 3B and 3C, wherein the center of lowermost apertures 16' in side 14' lies on the same plane as the lowermost cavity 18 on left edge of side 14, and the lowermost cavity 18" on the right edge of side 14", cavities 18 and 18" forming a muzzle tube port when sides 14, 14' and 14" are assembled into holder 12.

Figures 3A, 3B, 3C:
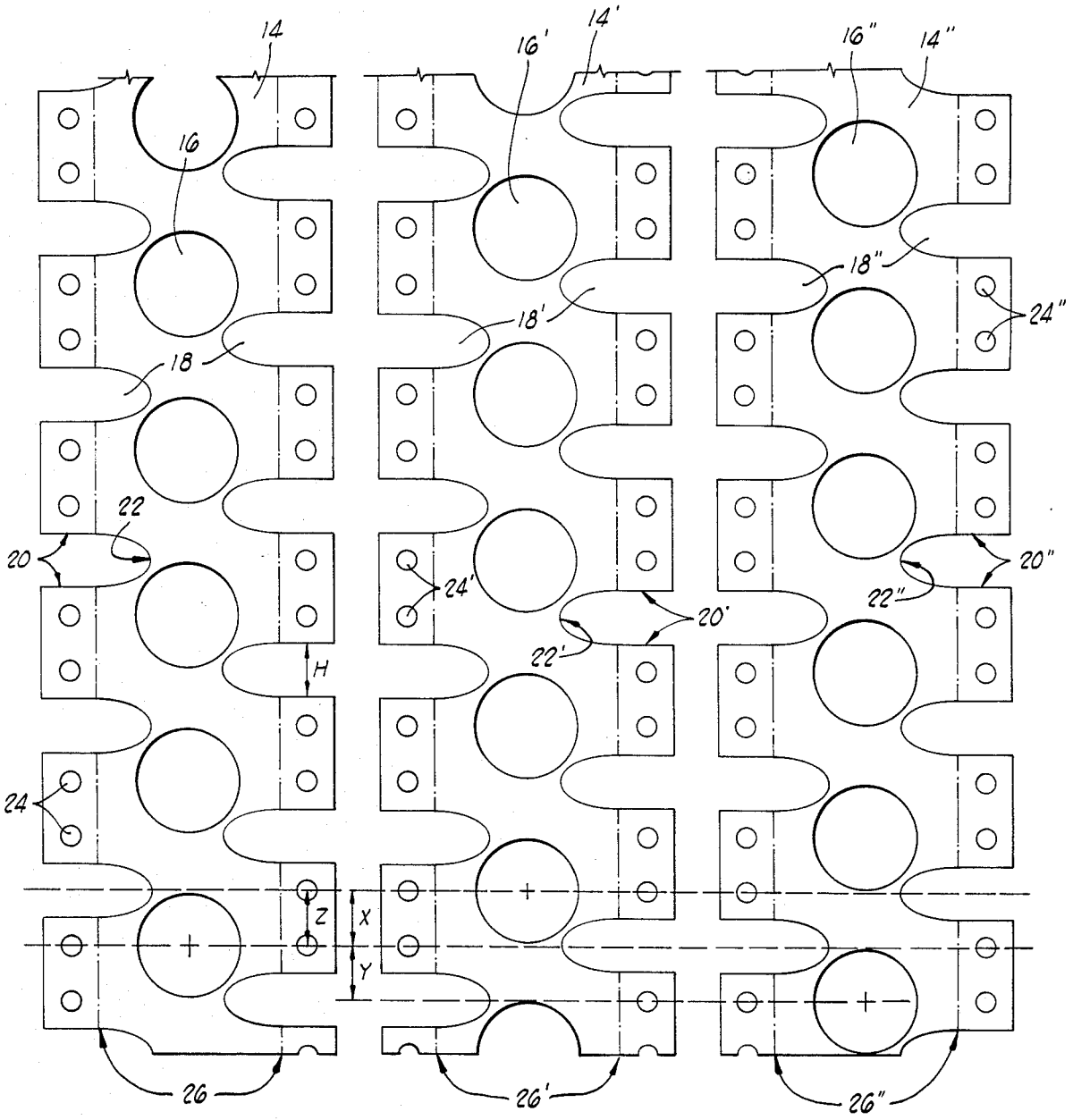
FIGS. 3A, 3B and 3C are flat layouts of three charge holder strips employed to form the sides of the charge holder employed in the preferred embodiment of the perforating gun of the present invention.

While the vertical offset of the charge apertures 16, 16' and 16" has previously been discussed as related to bolt hole spacing, it should be understood that such description was for purposes of convenience only. From the foregoing description of the formation of muzzle tube ports from adjacent cavities, it is evident that the minimum vertical spacing of the charge apertures is limited to the height necessary for the shaped charge explosive jet to pass through a muzzle tube port 80 without obstruction. This in turn is limited by the external diameter of walls 90 of muzzle tubes 46 where they pass through the muzzle tube ports. Such minimum spacing is illustrated in FIGS. 3A–3C, wherein it can be clearly seen that each set of cavities in an edge is vertically offset from the next higher cavity in the opposite edge of that same charge holder side by a distance equal to the vertical height H of the cavities, which in turn is equal to distances X, Y and Z.

Referring again to FIG. 1 of the drawings, holder 12 is shown assembled using hex head bolt and nut pairs 30 in bolt holes 24, 24' and 24". In FIG. 1, side 14" is facing the reader, the side 14 also being shown, and side 14' being hidden from view. However, it should be understood that other fastening means may be employed, such as sheet metal screw or rivets, and that the sides may also be spot-welded or brazed together, adhesively bonded, or may include tabs which interlock in order to hold sides 14, 14' and 14" together. Furthermore, charge holder 12 may be formed of a single piece of sheet metal, and bent on a sheet metal break as required to form its final shape. Furthermore, holder 12 could be an extrusion of metal or other material, with all necessary apertures formed therein by punching, cutting or machining after extrusion. All of the above and other procedures known in the art may be employed to form a charge holder in the configuration of the present invention.

It is thus apparent that a novel and unobvious perforating gun has been invented. Rather than being limited to a very small stand-off of about two (2) inches or less as in the prior art, the present invention may be employed to increase stand-off by several inches, or several hundred per cent. For example, in a $7\frac{1}{4}$ inch O.D. charge carrier having a wall thickness of $\frac{1}{2}$ inch, a charge depth (bottom to mouth) of $1\frac{3}{4}$ inches, a detonating cord diameter of 7/32 inches and a $\frac{1}{8}$ inch space between the cord and the inner wall of the charge carrier, the stand-off utilizing the present invention is approximately 4.15 inches. In contrast, using the same charges centered around an axially-placed detonating cord, the stand-off would only be about 1.25 inches. Thus, the present invention has increased the available stand-off by over 230 percent. In smaller diameter charge carriers, the relative increase available is even greater. For example, reducing the available inner diameter of a charge carrier by one (1) inch reduces the stand-off of each clustered charge by $\frac{1}{2}$ inch, to about $\frac{3}{4}$ of an inch. This reduces the stand-off with the perforating gun of the present invention to about 3.15 inches, which is 320 percent greater than the clustered charge stand-off.

Moreover, it is also apparent that the present invention permits vertical charge spacing by less than the charge width or diameter, the minimum vertical distance required being only sufficient for a charge jet to pass between the jets immediately above and below it in an unobstructed manner.

While the present invention has been described in terms of a preferred embodiment, it is not so limited. For example, the charge holder could be differently configured, as noted previously, and the muzzle tubes eliminated through use of barriers built into the holder to contain jet debris. Furthermore, a spirally wrapped detonating cord could be employed, a spit-back tube type initiating system used, or an electrical charge initiation system incorporated in the invention. Many other sizes and configurations of shaped charge housings, explosives and liners might be utilized, including both conical and curvi-linear liners. Moreover, the invention is not restricted to any particular housing, explosive or liner materials. Finally, the present invention is not restricted to perforating guns run inside of carriers; the muzzle tubes could be sealed at their outlet ends to provide fluid-free standoffs, and an O-ring seal disposed between the charge housings and the inlet ends of the muzzle tubes. These and other modifications, additions and deletions will be apparent to the skilled artison and may be made without departing from the spirit and scope of the claimed invention.

I claim:

1. A perforating gun for use in a well bore, comprising:

charge holder means having a substantially centered longitudinal axis therethrough;

at least one shaped charge adapted to produce a jet upon initiation and positioned in said charge holder means so that the path of said jet substantially intersects said substantially centered longitudinal axis; and charge initiation means.

2. The perforating gun of claim 1, wherein said at least one shaped charge comprises a plurality of shaped charges.

3. The perforating gun of claim 2, wherein the path of each of said jets is directed in a radial plane with respect to said substantially centered axis.

4. The perforating gun of claim 3, wherein all of said radial planes are non-intersecting.

5. The perforating gun of claim 4, wherein said plurality of shaped charges is disposed in said charge holder means in three substantially vertical rows about said substantially centered axis at substantially 120° spacing.

6. The perforating gun of claim 5, wherein each of said shaped charges is disposed in a different one of said rows than the said shaped charges in the said radial planes immediately thereabove and therebelow.

7. The perforating gun of claim 6, wherein the jet paths from one of said substantially vertical rows of shaped charges pass between the other two said substantially vertical rows of charges after intersecting said substantially centered charge holder means axis.

8. The perforating gun of claim 6, further including muzzle tube means associated with each of said plurality of shaped charges, said muzzle tube means defining a barrier substantially surrounding the path of said jet.

9. The perforating gun of claim 6, further including substantially tubular carrier means surrounding said charge holder means.

10. The perforating gun of claim 9, wherein said shaped charges are positioned immediately adjacent the inner wall of said carrier means.

11. The perforating gun of claim 6, wherein said charge initiation means comprises a detonating cord substantially vertically disposed adjacent each of said rows of shaped charges.

12. The perforating gun of claim 6, wherein said charge initiation means comprises a single detonating cord wrapped about said charge holder means and extending from the uppermost of said shaped charges in said holder means to said shaped charges on succeedingly lower radial planes.

13. The perforating gun of claim 2, wherein said plurality of charges are disposed in a pattern whereby said jets paths lie on non-intersecting radial planes and intersect said substantially centered axis.

14. A perforating gun for use in a well bore, comprising:

a substantially tubular carrier;

a plurality of shaped charges each having a mouth and a bottom and substantially symetrical about an axis extending therebetween;

a charge holder having a substantially central axis and means associated therewith adapted to aim said shaped charges inwardly toward said axis; and charge initiation means.

15. The perforating gun of claim 14, wherein the said axes of said shaped charges are disposed on non-intersecting radial planes with respect to said substantially centered charge holder axis.

16. The perforating gun of claim 15, wherein said plurality of charges are disposed in said charge holder in three substantially equally spaced vertical rows adjacent the inner circumference of said carrier and each of said charges is in a different vertical row than the said charges having axes disposed in the said non-intersecting radial planes immediately thereabove and therebelow.

17. The perforating gun of claim 16, further including a muzzle tube associated with the mouth of each of said shaped charges, said muzzle tubes substantially extending from said mouth along said charge axis through said charge holder axis to the inside wall of said carrier across said charge holder axis from said charge.

18. A method of perforating a wall of a well bore, comprising:

providing at least one shaped charge;

positioning said at least one shaped charge in said well bore;

aiming said at least one shaped charge substantially through the center axis of said well bore; and firing said at least one shaped charge.

19. The method of claim 18, further comprising:

providing a plurality of shaped charges;

positioning all of said plurality of shaped charges in said well bore;

aiming each of said charges in non-intersecting radial planes substantially through the center axis of said well bore; and firing said plurality of shaped charges.

20. The method of claim 19, further comprising:

disposing said shaped charges in one of three substantially equally circumferentially spaced substantially vertical rows in said well bore, whereby each of said shaped charges is disposed in a different vertical row than the said shaped charge aimed in the radial plane immediately thereabove and therebelow; and aiming all of said shaped charges in one of said substantially vertical rows between the other two substantially vertical rows.

* * * * *